US006425338B1

(12) United States Patent
Stevenson, IV

(10) Patent No.: US 6,425,338 B1
(45) Date of Patent: Jul. 30, 2002

(54) SPINNAKER POLE CONTROL SYSTEM FOR SAILBOATS

(76) Inventor: William H. Stevenson, IV, 28925 Island Creek Rd., Trappe, MD (US) 21673

( * ) Notice: Subject to any disclaimer, the term of this patent is extended or adjusted under 35 U.S.C. 154(b) by 0 days.

(21) Appl. No.: 09/821,023

(22) Filed: Mar. 30, 2001

(51) Int. Cl.[7] ..... B63H 9/04
(52) U.S. Cl. ..... 114/102.28; 114/89; 114/174
(58) Field of Search ..... 114/102.3, 102.28, 114/89, 111, 104, 105, 108, 174, 218

(56) References Cited

U.S. PATENT DOCUMENTS

| | | | | |
|---|---|---|---|---|
| 3,185,121 A | 5/1965 | Nilsen | 114/102.28 |
| 3,207,114 A | 9/1965 | Moseley | 114/102.28 |
| 3,228,372 A | 1/1966 | Ridder et al. | |
| 4,164,193 A | 8/1979 | Smith | 114/102.3 |
| 4,473,021 A | 9/1984 | Aronowitsch et al. | 114/89 |
| 4,598,658 A | 7/1986 | Eglais | 114/98 |
| 4,773,345 A | 9/1988 | Lilliehöök | 114/39.2 |
| 5,109,786 A | 5/1992 | Hall | 114/89 |
| 5,333,566 A | 8/1994 | Wasowski, Jr. | 114/102.28 |
| 5,347,945 A | 9/1994 | McAlpine | 114/102.28 |
| 5,558,035 A | 9/1996 | Klein | 114/89 |
| 5,937,779 A | 8/1999 | Murnikov | 114/104 |
| 6,070,545 A | 6/2000 | Keenan | 114/102.13 |
| 6,085,679 A | 7/2000 | Tiesler | 114/98 |

OTHER PUBLICATIONS

Ross, *Sail Power*, (1975), pp. 220–224.

*Primary Examiner*—Jesus D. Sotelo
(74) *Attorney, Agent, or Firm*—Michael de Angeli

(57) ABSTRACT

A spinnaker pole control system for a sailboat comprises an improved rigging arrangement, whereby the pole can be raised or lowered parallel to the deck, or dipped to allow jibing, by manipulation of a single control line. Improved pole control hardware simplifies preparation for flying a spinnaker and securing it when finished, and can be employed as a line stopper elsewhere.

29 Claims, 7 Drawing Sheets

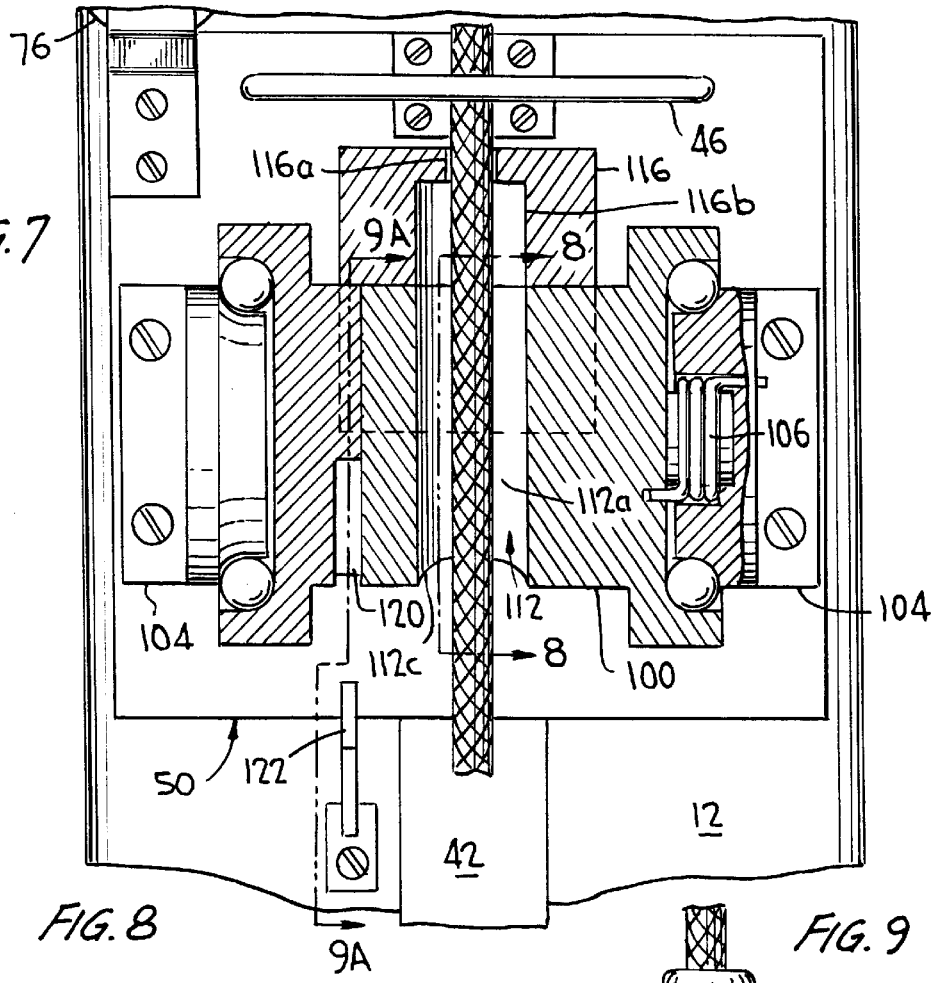
FIG. 7
FIG. 8
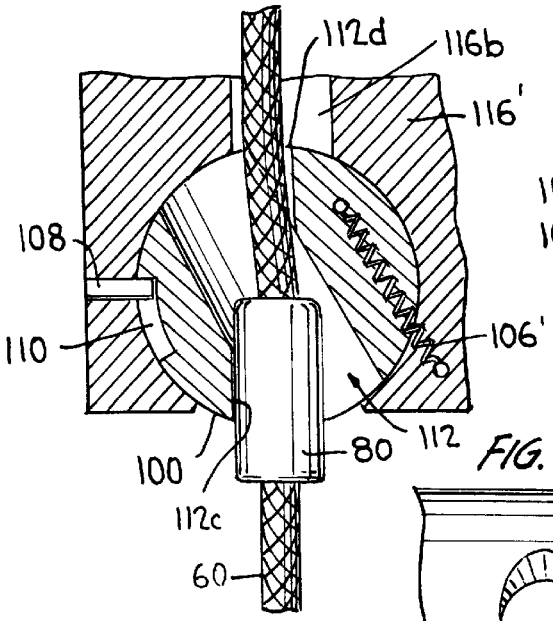
FIG. 9
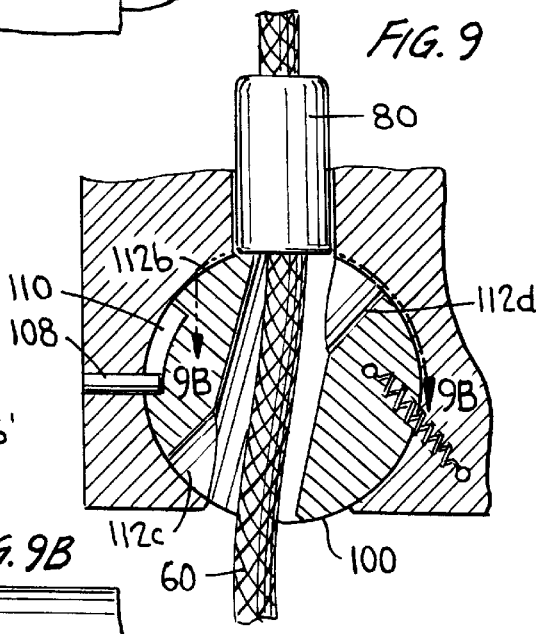
FIG. 9B
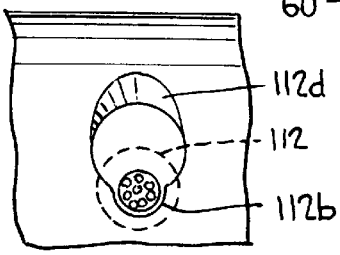

SPINNAKER POLE CONTROL SYSTEM FOR SAILBOATS

FIELD OF THE INVENTION

This invention relates to improved mechanical systems for handling spinnaker poles as used on sailboats.

BACKGROUND OF THE INVENTION

Numerous patents are directed to various devices for spinnaker poles and related equipment for handling spinnaker sails as used on sailboats, and recognize some of the same difficulties and problems inherent therein as addressed by the present invention.

More particularly, modern sailboats (at least those over some minimal length; smaller boats are generally less sophisticated), and which are intended for relatively high performance, especially for racing (similarly, "cruising" sailboats are commonly less sophisticated), typically "fly" "spinnaker" sails when sailing "off the wind". That is, when sailing upwind, sailboats typically rely on the combination of a mainsail and one or more jib sails; see, e.g., Keenan U.S. Pat. No. 6,070,545 for discussion of some of the considerations relevant to sailboats when sailing upwind. By comparison, when sailing off the wind, the jib is commonly lowered, and a spinnaker is flown.

A spinnaker may be considered to be a three-sided sail having an upper corner, or "head", that is hoisted to, or nearly to, the top of the sailboat's mast. All three of the spinnaker's edges are free, creating significant problems of sail control. (By comparison, a mainsail usually has one edge fixed to the mast and a second edge fixed to or closely constrained by a rigid spar, the "boom", while a jib normally has its leading edge constrained by the headstay of the boat, but two free edges.) As usually employed, one of the two lower corners of the spinnaker is termed the "tack", and the other the "clew". As will appear below, the assignment of these terms to the corners of the spinnaker can vary depending on the orientation of the boat with respect to the wind, complicating the precise definition of terms.

Traditionally, that is, over approximately the span of the last century, one of the corners of a spinnaker has been controlled by attachment (typically by way of an intermediary fitting, or a short length of wire rope, or line) to an outboard end of a spinnaker pole. (There are also spinnakers designed to be flown without poles. The invention is not directly relevant to these.) An inboard end of the pole is usually releasably fixed to the mast of the boat at a pivot point; the pivot point is defined by a fitting attached to the mast. Commonly, the mast fitting is mounted on a car, which can be moved by control lines up and down along a track affixed to the forward side of the mast. The car position is thus varied to control the shape of the sail, and the car is also moved up and down to perform a "dip-pole jibe", as discussed in detail below. The outboard end of the pole is controlled by a number of lines. Typically these control lines include a topping lift, running upwardly to or near the masthead to hoist the outboard end of the pole, a foreguy or downhaul extending down toward the foredeck to prevent upward movement of the pole end, and a pair of guys extending aft on either side of the boat to adjust the attitude of the pole with respect to the longitudinal centerline of the boat.

The corner of the spinnaker adjacent to the outboard end of the pole at any time is termed the tack; the third corner of the spinnaker is termed the clew, and is controlled by a line led aft toward the stern of the boat, termed the sheet. The situation is further complicated (both as to precise definition of terms, and as to smooth sail-handling) by the fact that the attitude of the spinnaker and its connection to the boat by the pole and the various lines mentioned must be altered during sailing, as the boat's attitude with respect to the wind changes.

More specifically, FIG. 1 shows a sailboat 10 on "port tack", that is, with the wind W blowing over the left or "port" side of the boat. As shown, mast 12 supports a mainsail 14 and a spinnaker 16, the head 18 of which has been hoisted to the masthead 20. The tack 22 of the spinnaker 16 is releasably fixed to the outboard end 29 of a spinnaker pole 26, the inboard end 27 of which is pivotally attached to mast 12. As noted above, and as shown in further detail below, the inboard end of pole 26 is affixed to mast 12 at a fitting allowing the pole to pivot freely with respect to mast 12, and which can be moved controllably upwardly and downwardly along a track 42 affixed to the forward side of mast 12. A topping lift 25 supports the outboard end of pole 26; the topping lift typically runs down inside mast 12 to a cleat or other fixing device. A foreguy 32 prevents the pole tip from unrestrained upward motion. Tension in a guy 36 and in the spinnaker itself adjust the angular position of the pole with respect to the centerline of the boat. A sheet 28 controls the clew of the spinnaker. A headstay 30 and a backstay 40 brace mast 12 fore and aft; shrouds on either side (not shown) provide lateral support for the mast.

The manuever undertaken when it is desired to change the attitude of the boat with respect to the wind so that the wind W comes over the right rear, or "starboard quarter", of the boat is called a "jibe" (sometimes "gybe"); jibing the boat from its attitude in FIG. 1 therefore involves turning it rightwardly through 45° or more. As part of this manuever, the spinnaker and pole must be controlled to assume the corresponding positions on the new starboard tack. In the spinnaker jibing procedure most pertinent to the present invention, the outboard end 29 of pole 26 is detached from the present tack 22, the pole is swung across the bow of the boat so that its end is disposed over the starboard side of the bow, and the outboard pole end 29 is attached to the present clew 24, which becomes the new tack. (In a so-called end-for-end jibe, practiced mostly with respect to smaller boats, the inboard end of the pole is detached from the mast and affixed to the new tack; the original outboard end of the pole is then detached from the former tack and affixed to the mast).

In simpler rigging schemes, mainly applicable to smaller boats, the line which forms the present guy 36 then becomes the sheet, while the present sheet 28 becomes the new guy. In the rigging arrangement commonly used on larger boats, pairs of both sheets and guys are provided, so that the lines used and their fittings can be optimized for the loads encountered. The extra sheet and guy are not shown in FIG. 1, to avoid complication. In the usual terminology, the "lazy" sheet becomes the "working" sheet upon jibing; the guys similarly change status and name upon jibing.

A number of US patents which provide background for the present invention are directed to devices for simplifying the process of disconnecting the end of the pole from one corner of the spinnaker, reconnecting it to the opposite end, and for interchange of the lazy and working sheets and guys. See generally McAlpine U.S. Pat. No. 5,347,945, Nilsen U.S. Pat. No. 3,185,121, Aronowitsch U.S. Pat. No. 4,473,021, Wasowski U.S. Pat. No. 5,333,566, Klein U.S. Pat. No. 5,558,035, Tiesler U.S. Pat. No. 6,085,679, Hall U.S. Pat. No. 5,109,786, Moseley U.S. Pat. No. 3,207,114, and Ridder U.S. Pat. No. 3,228,372. Smith U.S. Pat. No. 4,164,193, Eglais U.S. Pat No. 4,598,658, Lillehook U.S. Pat. No. 4,773,345, and Murnikov U.S. Pat. No. 5,937,779 are also generally relevant to the various problems encountered in control of spinnakers and other sails on sailboats.

As noted, most of the cited art is directed to the problem of interchanging the sheets and guys, and disconnecting the pole end from one corner of the sail and connecting it to the other corner. A concern which is less often addressed but also very significant is the control of the pole itself. Although spinnaker poles have grown increasingly lightweight in recent years, thanks to the availability of sophisticated materials such as epoxy-impregated carbon and "Kevlar" fibers, they are still large and unwieldy, and can be dangerous to handle, especially given the often-difficult conditions on the foredecks of ocean-going sailboats.

There are several different ways to exchange the corner of the spinnaker that is affixed to the outboard pole end during a jibe. As noted, smaller boats typically use the "end-for-end" jibe. In this manuever, the inboard end of the pole is detached from the mast fitting; the pole, with its weight borne by the topping lift (which on smaller boats is commonly connected to a "bridle" of wire rope extending between the pole ends; the downhaul or foreguy may be attached to a similar bridle on the opposite side of the pole), is swung through the "foretriangle" between the headstay and mast, and its previous inboard end is engaged with the corner of the sail that is then controlled by the sheet, i.e., the previous clew; the outboard end of the pole is then detached from the previous tack, and brought toward and engaged with the mast fitting, becoming the new inboard end. This process requires a crewmember to physically control the pole during the period it is free from the mast; this requires considerable strength and coordination with the other crewmembers, and is unsuitable for large boats.

On larger boats, therefore, the inboard end of the pole remains attached to the mast, while the outboard end is freed from the tack and pivoted over the bow as the boat turns through the wind. The sheet/guy arrangements shown in the patents referred to above, and others described therein and elsewhere, are commonly used to bring the outboard end of the pole into engagement with the new tack. See Ross, Sail Power, FIG. 147(*a*) –(*c*) for a further description of some of these arrangements.

In order that the spinnaker pole can swing from one side of the boat to the other during a jibe, its outboard end must pass by the forestay. Commonly, the pole is longer than the horizontal distance between the mast and headstay at its typical working height. The common practice employed to work around this problem is the "dip-pole" jibe. As noted above, the fitting attaching the inboard end 27 of the pole to the mast 12 is commonly mounted on a "car" sliding along a track 42 fixed to the forward side of the mast, under the control of opposed lines. In the dip-pole jibing manuever, the car is lifted while the topping lift is eased, lowering the outboard end of the pole toward the deck, so that the outboard end of the pole can be swung across the bow, passing between the headstay and deck.

The "dip-pole" jibe manuever is sometimes known as a Vim jibe, after the 1958 12-meter yacht on which this practice was originated. See the Ridder patent at col. 3, and Ross. As noted by Ridder in particular, this manuever requires several well-trained crewmembers, since the lines raising the car and easing the topping lift must be operated by two crewmembers in synchronism to dip the pole, while others must operate the sheets and guys to swing the pole end beneath the headstay. The dip-pole jibing process is fraught with potential problems and even if successfully accomplished takes some time to perform properly, since all of the lines that are operated in performance of the maneuver must then be cooperatively adjusted in order to bring the sail to its proper shape and attitude. Specifically, saving of even a few seconds on each jibe is a potential advantage well worth pursuing, especially given the highly competitive nature of modern sailboat racing. Likewise, any improvement in the process that makes it more reliable or allows reduction in the number of crewmembers involved is highly desirable, from the point of view of speed and efficiency as well as that of safety.

OBJECTS OF THE INVENTION

The present invention is therefore directed to improvements in spinnaker pole control as employed in particular in dip-pole jibing manuevers, although the improved spinnaker handling gear provided according to the invention is useful in connection with other types of spinnaker control procedures, and with spinnaker poles that do not require the dip-pole manuever for jibing.

Another object of the invention is to provide improved equipment for securing a line at a predetermined position, such that the line can be brought to the desired position rapidly and reliably, secured instantly in a manner which eliminates frictional damage to the line, and released immediately when desired.

SUMMARY OF THE INVENTION

According to the present invention, a novel spinnaker pole control system, comprising both novel gear and a novel rigging arrangement, is provided. As above, the conventional pole car comprises a fitting for pivoting attachment of the inboard end of the spinnaker pole, and typically slides up and down along a track affixed to the forward side of the mast under the control of hoisting and lowering lines. According to one aspect of the invention, the conventional car is replaced with a new car to which the inboard end of the pole is secured. The car has the capability to automatically grip a "pole control line" at a predetermined position along the line; in the preferred embodiment, this predetermined position is defined by a "slug" fitting attached to the pole control line. According to the improved rigging arrangement of the invention, a single pole control line provides the functions previously performed by both the topping lift, that is, hoisting the outboard end of the pole, and by the car hoisting and lowering line, that is, control of the height of the car and thus of the inboard end of the pole; accordingly, adjustment of the pole control line allows the pole to be set at any desired height above the deck, which is important in controlling the spinnaker's shape to maximize its efficiency in propelling the boat.

More specifically, according to the invention, a single pole control line runs from the outboard end of the spinnaker pole (or bridle, if used) upward to the masthead, downward to a sheave at the foot of the mast, upward to or through the car to a sheave at the upper end of the track (with a multipurchase tackle optionally interposed at this point), and downwardly to the mast base; at that point the pole control line can be led back to the cockpit and cleated off. The slug mentioned above is interposed at a desired position in the portion of the pole control line running upward from the sheave at the mast base to the car, and does not interfere with the passage of the line over the various sheaves. The slug and car cooperate to limit the extent the line runs upwardly through the car; that is, the line runs freely through the car until the slug reaches the car, at which point the slug is secured to the car, preventing further movement of the line through the car.

More specifically, when the pole is not in use, the pole control line must be free to allow the pole to be lowered to the deck, out of the way. When the pole is to be used, the line is pulled through the system until the slug encounters the car and is secured to the car. As noted, when the slug is locked to the car, the line cannot slide further through the car. Therefore, further movement of the line hoists the car (and thus the inboard end of the pole) and the outboard end of the pole by substantially equal increments. By properly locating the slug along the line at installation of the system according to the invention, the pole can thus be arranged to repeatedly take any desired attitude with respect to the mast; normally the slug will be located so that the pole is substantially perpendicular to the mast. As noted, further movement of the line will lift the pole without significantly changing its attitude with respect to the mast. In these aspects, the invention is useful with boats using all sorts of spinnaker poles, that is, those which practice the end-for-end jibe as well as those performing the dip-pole jibe.

As noted, a multipurchase tackle, typically providing a 3:1 ratio, can be interposed in the line between the car and the sheave above the car on the mast. The tackle simply comprises a sheave on the car and a second sheave on the mast above the car. This tackle reduces the load encountered in lifting the pole, and provides further advantages when employed in connection with the dip-pole jibe. Specifically, when it is desired to jibe the boat, the slug is released from the car, but the cockpit end of the pole control line is not released. Pulling the pole control line downwardly through the car therefore lifts the car and the inboard end of the pole, while simultaneously lowering the outboard end of the pole, "dipping" the pole and allowing its outboard end to pass between the forestay and deck. The tackle sets the ratio by which the inboard end is lifted with respect to that at which the outboard end is lowered when dipping the pole to jibe. After the pole is clear of the forestay, the line is pulled back upwardly until the slug is again engaged by the car; this automatically returns both inboard and outboard ends of the pole to their former locations, avoiding the "tweaking" of lines that is an inevitable part of the conventional practice. Further adjustments that may be desired in the pole height can then be made by adjustment of the free end of the pole control line, e.g., from the cockpit.

In a particularly preferred embodiment, the car and slug cooperate so that the slug can be released from the car in preparation for a jibe simply by pulling the line in a specific direction. Further, the car may be provided with a catch cooperating with a control arm fixed with respect to the mast, so that the slug is automatically released from the car when the car is lowered to its inactive position along the deck, simplifying the process of stowing the spinnaker and its gear when a new point of sail is anticipated. The same control arm may retain the car until needed, simplifying its preparation for the next use.

A novel design for the slug and the securing mechanism is also provided, which may find use elsewhere on sailboats in situations where lines are repeatedly secured at the same position.

BRIEF DESCRIPTION OF THE DRAWINGS

The invention will be better understood if reference is made to the accompanying drawings, in which:

FIG. 7 shows the car of FIG. 6, seen from the bow of the boat, and includes a cross-sectional view of the locking cylinder which receives and retains the slug;

FIGS. 8–12 are comparable cross-sectional views through the locking cylinder of FIG. 7, and show the cylinder, line, and slug in various positions encountered during sailing manuevers;

FIG. 9B is a detail view, taken along the line 9B—9B of FIG. 9;

DESCRIPTION OF THE PREFERRED EMBODIMENTS

Figure 1:
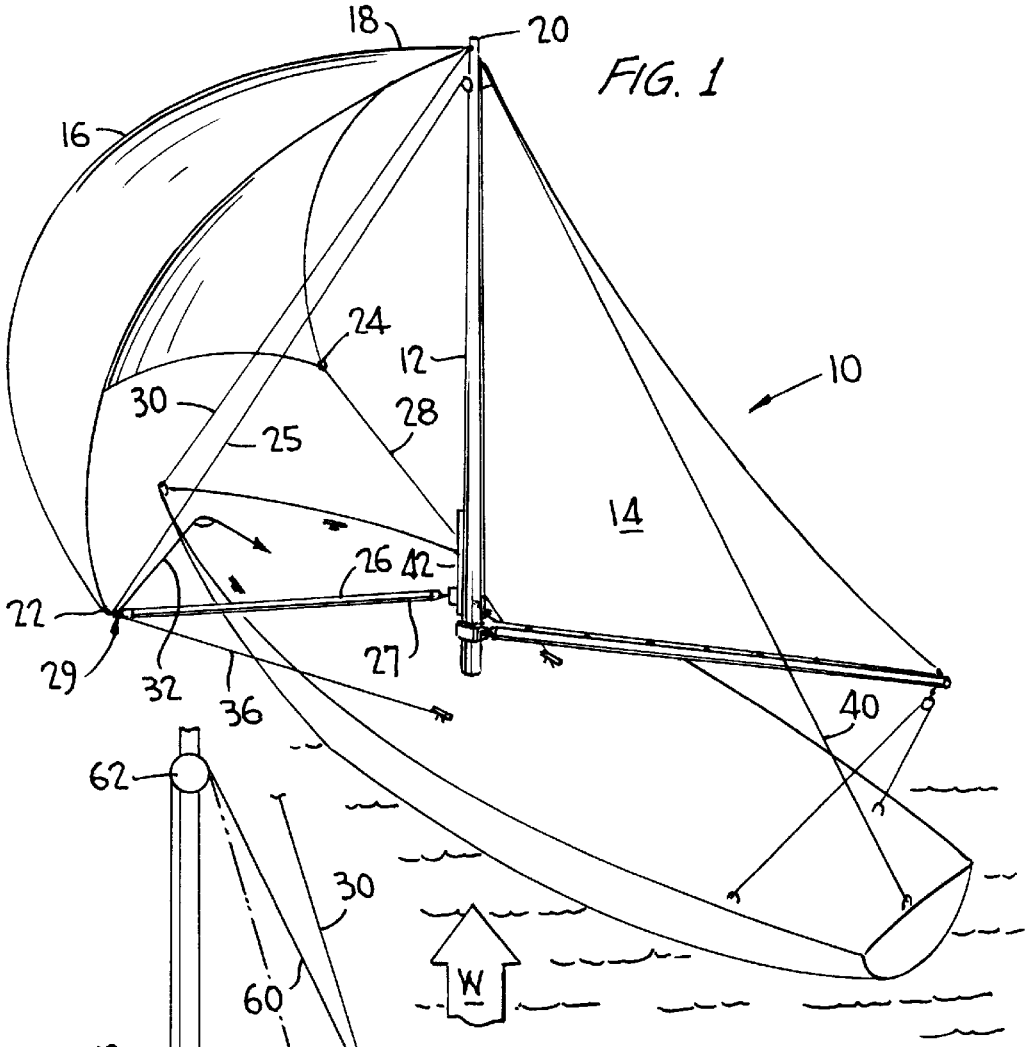
FIG. 1 shows a perspective view of a sailboat as may employ the improved spinnaker pole control system of the invention.

As mentioned above, FIG. 1 shows a sailboat 10 utilizing the improved spinnaker handling apparatus and rigging arrangement of the invention. As noted above, the invention in all its aspects is particularly useful on larger boats that practice the dip-pole spinnaker jibing manuever, although certain aspects of the invention are also useful on boats practicing the end-for-end jibe. The former is discussed in detail, for completeness. Thus, as discussed in detail above, in order to jibe the boat, the inboard end of the spinnaker pole 26 must be hoisted along the track 42 on the forward side of the mast 12, while the outboard end 29 of pole 26 is lowered; this allows the outboard end 29 to pass between the forestay 30 and the deck of the boat. After the jibe has been accomplished, the pole ends must be returned to their respective prior altitudes, so that the sail takes the proper shape for aerodynamic efficiency.

As above, according to the improved rigging arrangement of the invention, a single pole control line provides the functions previously performed by both the topping lift, that is, hoisting the outboard end of the pole, and by the car hoisting and lowering line, that is, control of the height of the car and thus of the inboard end of the pole; accordingly, adjustment of the pole control line allows the pole to be set at any desired height above the deck, which is important in controlling the spinnaker's shape to maximize its efficiency in propelling the boat.

Additional aspects of spinnaker handling that have varying effect on the preferred implementation of the invention, as discussed in detail below, include the following:

When not in use, the pole must be conveniently dropped and secured to the deck, and the topping lift section of the pole control line secured near the mast, so as to be out of the way. To simplify these steps, the topping lift is freed automatically when the car carrying the inboard end of the pole is lowered to the deck, saving a crewmember the step of releasing the line. At the same time, the car is secured, both for safety and also so that it need not be separately restrained by a crewmember when the line is pulled through it in preparation for the next spinnaker use correspondingly, in preparation for a spinnaker "set", the inboard end of the pole is fixed to the car if necessary, and the pole control line is pulled through the car until a "slug" fixed to the line at a particular point along its length is engaged in the car. This releases the car from its secured position at the same time that the topping lift is tensioned, so that further pulling on the line lifts the pole parallel to the deck.

When the pole is to be jibed, the line below the car is pulled in a given direction (that is, off to one side) to release the slug from the car, without freeing the end of the line led to the cockpit. Pulling downwardly on the line then lifts the car and simultaneously lowers the outboard end of the pole, dipping it so as to be passed between the deck and forestay. After the pole passes across the bow, the line is pulled upwardly, returning the pole to its parallel position and again engaging the slug in the car. The pole is thus dipped and raised to its original height simply by pulling a single line first in one direction, then another, and no attention need be paid to the position of the pole ends to ensure its return to the proper attitude.

Figure 2:
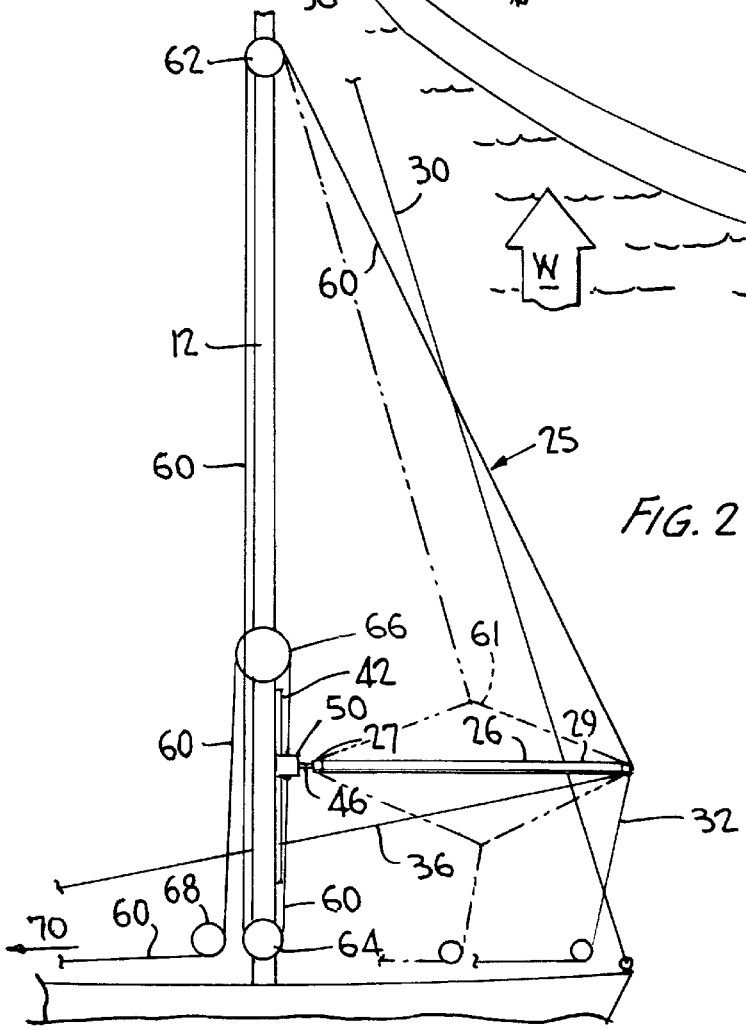
FIG. 2 is a side elevation of a boat illustrating the improved rigging arrangement as employed according to the invention.

FIG. 2 shows the principal components of the improved rigging arrangement of the invention, in a somewhat simplified implementation. As previously, topping lift 25, downhaul or foreguy 32, and guy 36 control the location of the outboard end 29 of pole 26, along with the spinnaker itself (not shown); however, as explained in detail below, according to the invention the topping lift is an integral part of a pole control line 60 that also performs other functions. The inboard end 27 of pole 26 is affixed to a fitting 46 carried on car 50; the pole end and fitting 46 cooperate so as to allow the pole 26 to pivot freely through a substantial range of motion. Car 50 is mounted on track 42 for vertical movement along the forward side of mast 12.

In the simplest implementation of the invention, shown in FIG. 2, a single pole control line 60 runs from the outboard end 29 of the spinnaker pole 26 (or from the center of a pole bridle 61, as shown in dotted lines; if the topping lift is attached to such a bridle, so will be the foreguy, as also shown in dotted lines) upward to a first sheave 62 near the masthead, downward to a second sheave 64 at the foot of the mast, upward to or through the control car 50 to a third sheave 66 fixed to the mast at or above the upper end of the pole car track 42, and downwardly to the mast base; at that point the free end of pole control line can be led back to the cockpit via a fourth sheave 68, and cleated off as desired. (Sheaves 62, 64, and 66, in particular, are shown larger than scale to make the drawing more clear; in practice, these are usually quite small, and may be largely internal to mast 12. Similarly, the section of line 60 running downwardly from the masthead sheave is normally run internal to mast 12.)

As mentioned, the line 60 can be releasably fixed to the car 50; it will be appreciated that when line 60 is thus fixed to car 50, tension applied to the free end of line 60 at 70 will pull the car 50 and the outer end of pole 26 upwardly at the same linear rate. However, because the portion of line 60 pulling upwardly on car 50 (i.e. from sheave 66) and the portion of line 60 effectively serving as the topping lift (i.e., the portion running from the outer end 29 of the pole to the masthead) are not parallel, the inner and outer ends of the pole are not lifted at precisely the same rate. In particular, the car is lifted somewhat more slowly than the outer end 29 of the pole 26; however, since on modern boats the height of the mast is much greater than the length of the pole, in practice the pole attitude changes very little during the lifting process. Reference herein to the pole's remaining perpendicular to the mast (or, equivalently, parallel to the deck) during the lifting operation is meant to include this minor change in the attitude of the pole during lifting.

Figure 3:
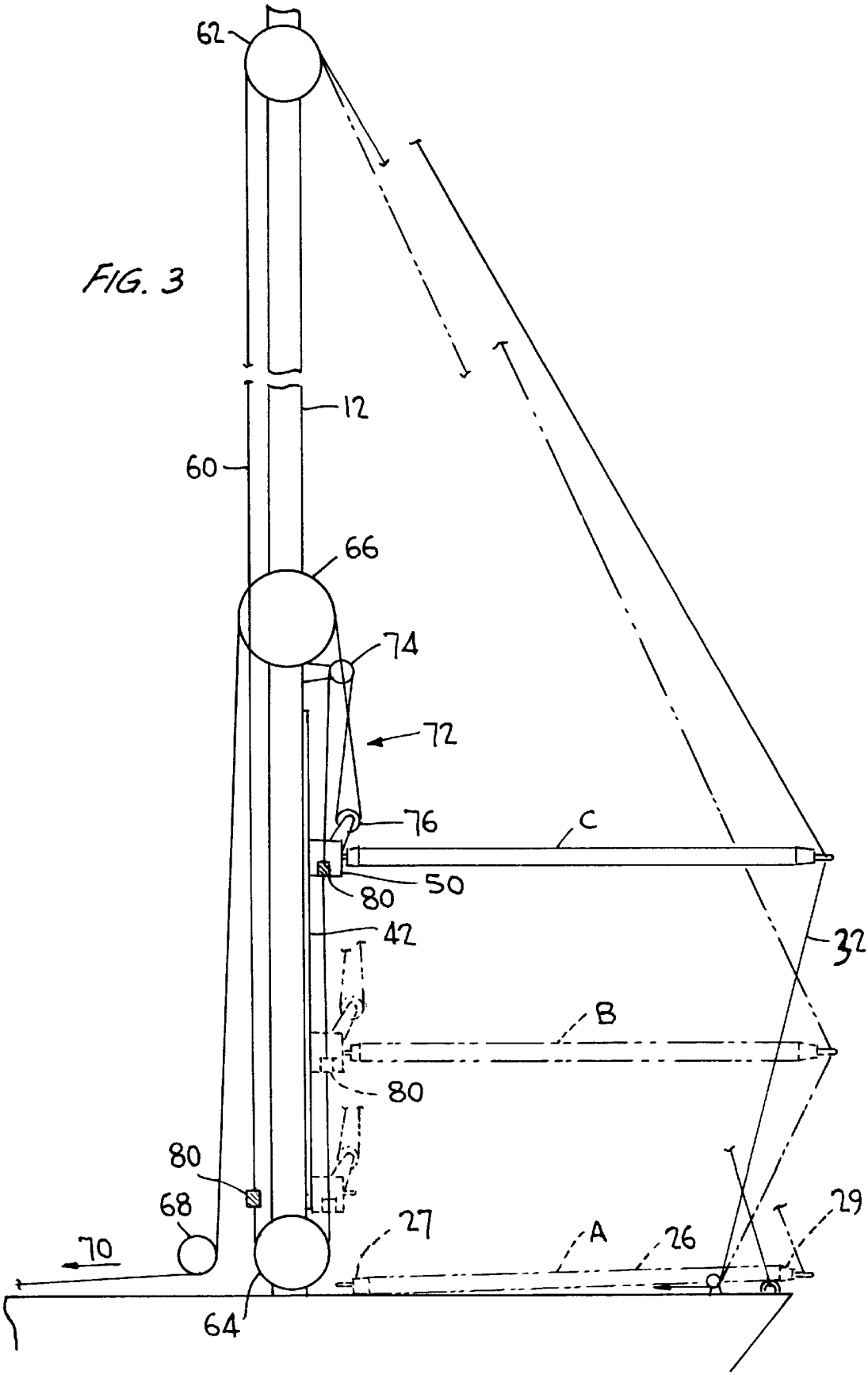
FIG. 3 is a view comparable to a portion of FIG. 2, but enlarged for clarity, and showing the operation of the system in raising the pole from its inactive position, with the slug released from the car, and raising the pole perpendicular to the mast, with the slug engaged in the car.

FIG. 3 shows the preferred embodiment of the invention, in which line 60 is releasably fixed to car 50 when a slug 80 fixed to line 60 is engaged by car 50, and in which a multi-purchase tackle 72 is interposed in the run of pole control line 60. FIG. 3 also illustrates the motion of the pole 26 parallel to the deck in further detail. More specifically, a three-part tackle 72, comprising a further sheave 74 fixed to the mast 12 at or above the upper end of track 42 and a sheave 76 fixed to the car, is interposed in the run of pole control line 60 between the sheave 64 at the mast base and sheave 66 at the upper end of track 42. Accordingly, when tension is applied to the free end of line 60 at 70, the mechanical advantage provided by the tackle 72 is applied to the lifting of the car and pole. More particularly, because the tackle 72 is in the run of the line between the point at which tension is applied, i.e., at 70, and both the car 60 and the outboard end 29 of the pole, both ends of the pole are lifted equally by the tackle, and the work of lifting the pole is eased accordingly.

FIG. 3 also shows the pole 26 in three positions, labeled A, B, and C. In position A, the inboard end 27 of the pole can be detached from the car 50, allowing the pole to be stowed; typically chocks (not shown) will be provided to secure the pole along the deck when not in use. In this inactive position, slug 80 is freed from the car 50, so that the end of line 60 connected to the outboard end of pole 26 can be detached therefrom and brought back to the mast for stowing out of the way. Alternatively, the line end can remain attached to the outboard end of pole 26, and enough slack pulled in the line so that it lies generally along the pole and the mast, again in order to be out of the way. As noted above, and as discussed in detail below, in the preferred embodiment, the slug is freed from the car automatically upon the car's being lowered to position A, simplifying the securing of the pole.

FIG. 3 also shows the slug 80, which as noted is affixed to the pole control line 60 at a predetermined position therealong, at three different positions. When the pole 26 is in position A, the slug 80 is pulled around sheave 64 to provide sufficient slack in line 60 to allow it to be stowed out of the way, as above. Accordingly, and in order to simplify rigging the boat according to the invention, the slug 80 must be capable of passing the various sheaves. Several different embodiments of slug 80 are described below.

When it is desired to ready the pole for use, its inboard end 27 is affixed to the car 50 if necessary, and its outer end freed from any chock employed to restrain it when not in use.

Tension is then applied to the free end of line 60, at 70, pulling it toward the cockpit; as the slack is pulled out of line 60, and pole 26 is hoisted to a level position, slug 80 passes around sheave 64, and is received in and engaged by car 50, preferably in a manner discussed in detail below. Thereafter, pulling the line further by tension applied at 70, while the foreguy 32 is correspondingly slacked, hoists car 50 and outer end 29 of pole 26, as indicated at B and C. As noted above, the attitude of pole 26 remains substantially perpendicular to mast 12 during the lifting operation, as shown. It will be appreciated that the position of slug 80 along line 60 is important in establishing the attitude of pole 26 with respect to mast 12; the correct position is established when the system is installed. The manner in which slug 80 may be attached at a desired position along line 60 is discussed below with respect to two different embodiments of slug 80.

Thus, the system shown in FIG. 3 provides a spinnaker pole control system wherein a single line simultaneously hoists both ends of the pole. This is useful on all boats employing spinnaker poles, even those practicing the end-for-end jibe; that is, single-line control of the position of the spinnaker pole according to the invention is already a significant advantage over the art. As noted, on the smaller boats practicing the end-for-end jibe, the spinnaker pole is typically supported by connecting the topping lift to a bridle, so that the entire pole is supported by the topping lift.

Figure 5:
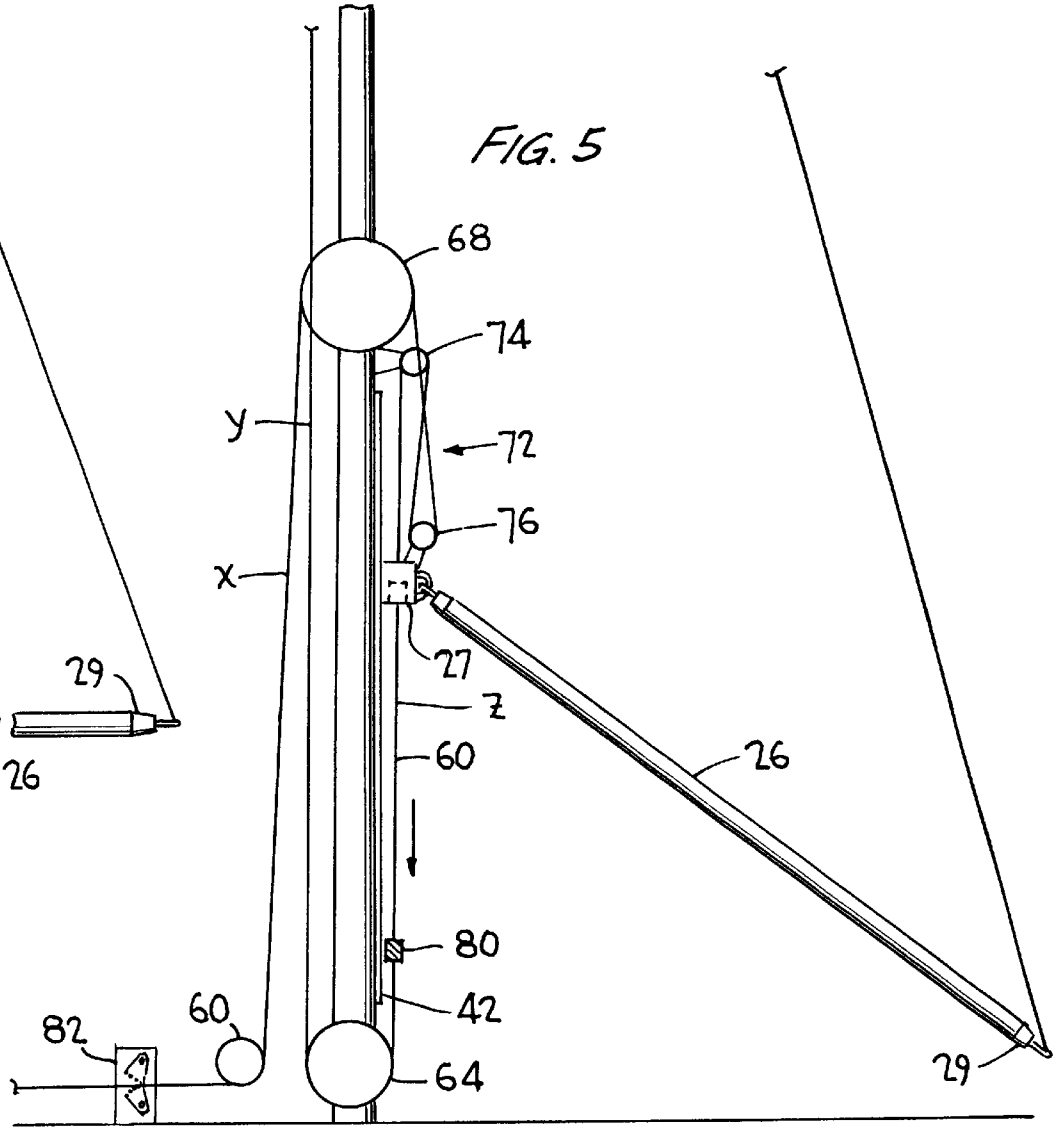
FIG. 5 is comparable to FIG. 4, but shows the dipping of the pole with the slug disengaged from the car.
Figure 4:
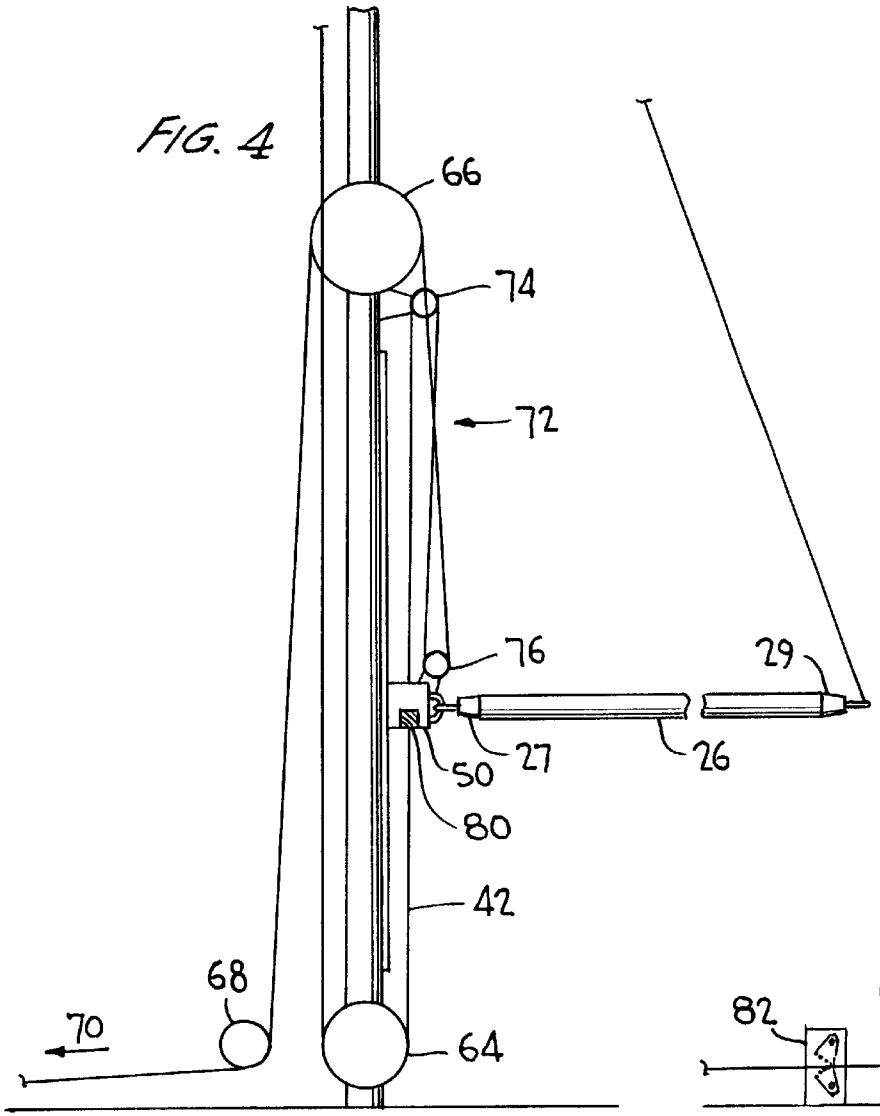
FIG. 4 is comparable to FIG. 3, but shows a simplified view for clarity.

FIGS. 4 and 5 are comparable simplified views provided to allow clear understanding of the operation of the system of the invention during the dip-pole operation. More specifically, FIG. 4 is similar to FIG. 3, in that slug 80 is engaged by car 50, so that tension applied at 70 lifts the car, and thus the inboard end of pole 26, as well as the outboard end 29. When a desired height is reached, the free end of line 60 is cleated or otherwise secured, as indicated at 82, showing schematically a conventional "line stopper" line securing device. If it is then desired to dip the pole to jibe the boat, slug 80 is disengaged from car 50 (preferably in a manner discussed below), and the section of line 60 below car 50, marked Z, is pulled downwardly. This has the effect of lifting the car 50 via tackle 72, while lowering the outboard end 29 of pole 26, as illustrated by FIG. 5.

It will be appreciated that as the slug 80 is disengaged from car 50 during this process, the section of line 60 passing through car 50 no longer forms an effective part of tackle 72; accordingly, if a three-part tackle 72 is provided, as illustrated, it effectively becomes a two-part tackle during the dipping operation, so that the car is raised one foot for each two feet by which the portion of line 60 supporting the outboard end 29 of pole 26 is lengthened. The effect is to dip the pole very efficiently, allowing its outboard tip to be passed between the forestay and deck. After the pole has cleared the forestay, the line is pulled in the opposite direction, typically by pulling upwardly on portion Z, running from sheave 64 toward sheave 74, until the slug 80 reengages car 50. (Equivalently, a crewmember could pull downwardly on the portion of line 60 marked Y, running from the mast head to sheave 64; however, as noted above, this could be internal to the mast 12, and thus inaccessible.) At this point the pole will have been returned to its original attitude with respect to mast 12; any further adjustments desired in its height can be made by manipulating the free end from the cockpit.

As noted, the pole is moved up and down parallel to the deck in order to adjust the shape of the spinnaker. Tensioning the pole control line lifts the pole, and normally gravity will pull it down if the line is slacked. However, under some circumstances, e.g. when flying a spinnaker in a relatively stiff breeze, gravity may be insufficient; in that case the foreguy 32 can be tensioned to positively pull the pole tip down, thus tensioning the topping lift. However, because according to the invention the topping lift forms part of the pole control line, thus tensioning the foreguy also pulls the car down, thus providing further positive sail control not available according to the prior art.

In the event the pole must be pulled even more closely to vertical than shown in FIG. 5, e.g., if the pole is a "penalty pole", that is, is extremely long as compared to the distance between the mast and forestay, it is preferable to move both ends of the pole through an equal distance when the pole is dipped during jibing. This can be accomplished by releasing the slug from the car and pulling downwardly on the sections of pole control line marked X and Z in FIG. 5. Several of the principal advantages provided by the invention, that is, that both ends of the pole are controlled by a single line, and the pole returns to its original attitude automatically, are still achieved. Moreover, the tackle still provides a 3:1 mechanical advantage in hoisting the pole overall.

There will occur to those of skill in the art several methods whereby the pole control line can be releasably secured to the car, and thus obtain single-line pole control according to that aspect of the invention. However, for further convenience and speed in sail control manuevers, the preferred combination of car, slug, and control mechanism has the following attributes:

When the line is pulled upwardly through the car, e.g., upon initial preparation to fly the spinnaker, or after the pole passes through the forestay in a jibe, the slug is to be received in and retained by the car, fixing the line with respect to the car.

The slug should be released from the car, in initiating the dip-pole manuever, by a simple manipulation of the line by a crewmember.

When the car is dropped to its inactive position (e.g., position A in FIG. 3), the slug should be released by the car, so as to free the line, and the car should be retained in the inactive position.

When the line is pulled through the car in preparation for a spinnaker set, the car should be released from the inactive position.

The preferred car, control arm, and slug shown in FIGS. 6–12 achieve these objectives.

Figure 6:
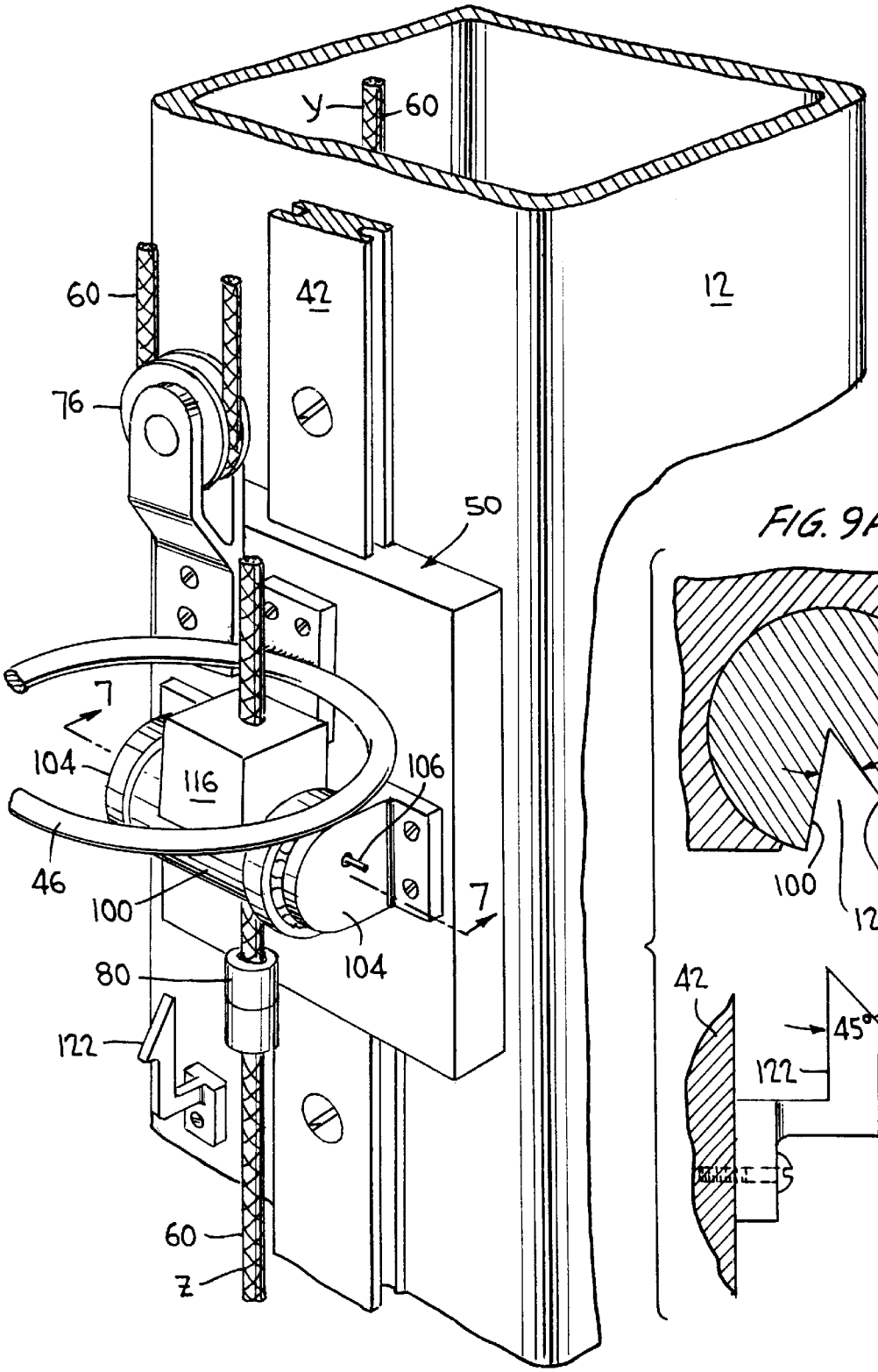
FIG. 6 shows a perspective view of the car, and illustrates a portion of the track and mast, and the control arm.
Figure 9A:
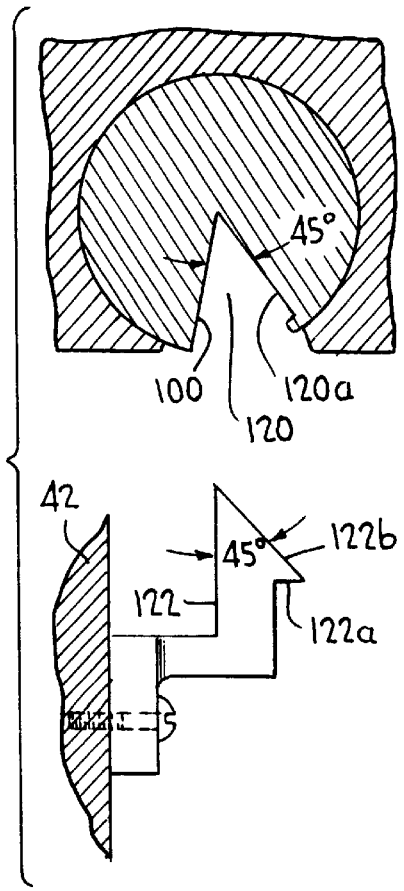
FIGS. 9A, 11A and 12A are cross-sectional views through the cylinder along the line 9A—9A of FIG. 7, showing its interaction with the control arm.
Figure 10:
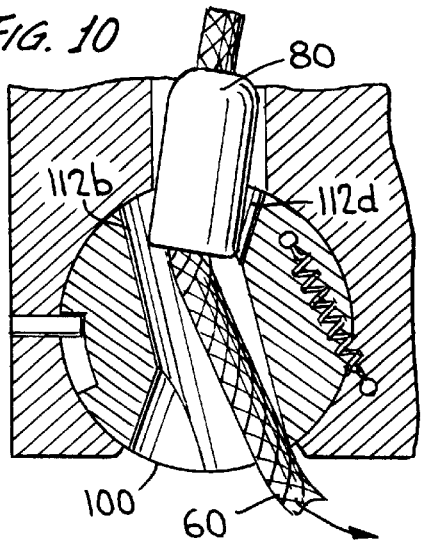
Figure 11:
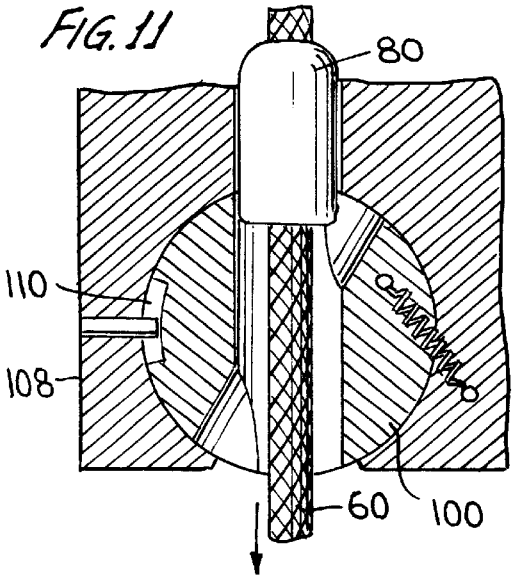
Figure 11A:
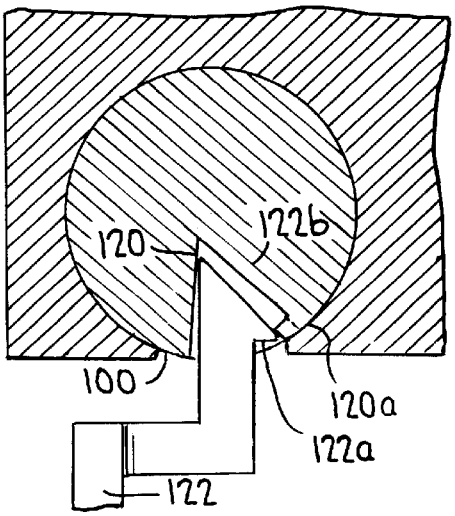
Figure 12:
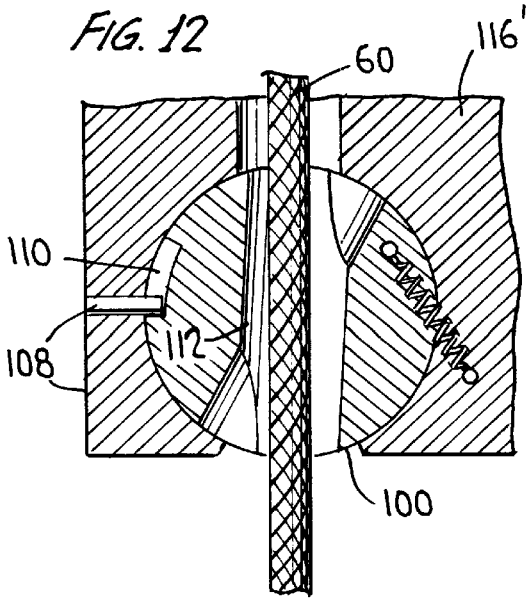
Figure 12A:
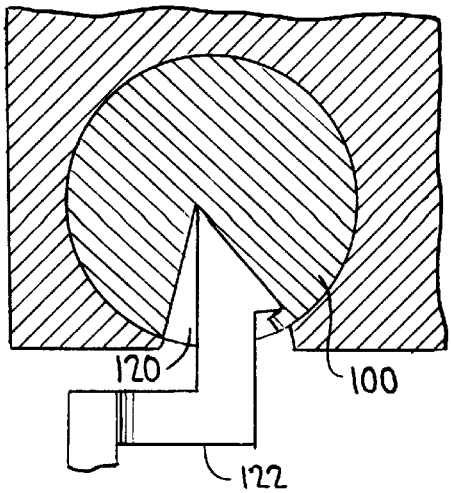
Figure 15:
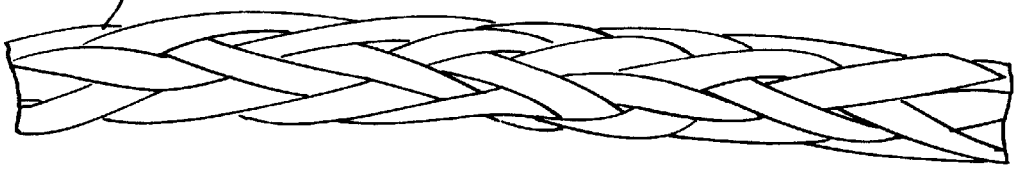
FIGS. 15 and 16 illustrate the core of a modern line that is preferred for the pole control line, having had its cover removed, and in its tensioned and untensioned configurations.

As mentioned, FIG. 6 shows a perspective view of the car assembly, while FIG. 7 shows a partial cross-sectional view along the line 7—7 thereof. FIGS. 8–12 show a series of cross-sectional views generally along the line 8—8 of FIG. 7, although illustrating a slightly different embodiment, for clarity, showing the components in different respective positions to illustrate their cooperation, and FIGS. 9A, 11A and 12A are cross-sections taken along line 9A—9A of FIG. 7, again illustrating the alternative embodiment, and showing the components in different respective positions to illustrate their cooperation.

Thus, in FIG. 6, the car 50 is shown sliding vertically along track 42 affixed to the forward surface of mast 12. Conventional bearings are provided therebetween to ensure smooth movement. The spinnaker pole is affixed by a conventional end fitting to a ring or other fitting 46 affixed to car 50. Section Y of the control line 60 is shown inside mast 12, on its run downward from masthead sheave 62; section Z is also shown, passing upwardly from sheave 64 through a locking cylinder 100. Line 60 is also shown passing over sheave 76 forming part of three-part tackle 72. Slug 80 is fixed to line 60 at a location determined at installation of the system. Control arm 122 is fixed near the base of mast 12.

As illustrated, locking cylinder 100 is journaled with respect to car 50 for rotation about a horizontal axis. In the embodiment shown, this is accomplished by disposing cylinder 100 between opposed bearing carriers (i.e., pillow blocks) 104; as conventional in sailboat hardware, open races with plastic ball bearings may be used, but the invention is of course not thus limited.

The locking cylinder 100 is biased to rotate in one direction, that is, counterclockwise in the view of FIG. 6, or clockwise in the views of FIGS. 8–12. The biasing is preferably accomplished with a hairpin-type spring 106, as illustrated in FIGS. 6 and 7, secured between one of the bearing carriers 104 and cylinder 100. However, for clarity of explanation, the biasing is shown being provided by a tension spring 106' in the alternative embodiment of FIGS. 8–12. The amount of rotation permitted to cylinder 100 is limited, e.g. by a pin 108 secured with respect to the car 50 and fitting within an arcuate recess 110 in the cylinder 100. The "rest position" of cylinder 100, as assumed when not being rotated against the bias of spring 106', is as shown in FIG. 9, where pin 108 abuts the lower end of slot 110. More particularly, in the preferred embodiment of FIGS. 6 and 7, cylinder 100 is juxtaposed to a guide block 116, which is fixed to car 50; in FIGS. 8–12, this assembly is shown simply as a solid member 116' surrounding cylinder 100, to simplify the explanation of the relationship between the various components.

As mentioned above, the pole control line 60 passes through the cylinder 100, more particularly, through a contoured bore 112 through the center of cylinder 100. As illustrated, bore 112 comprises a central cylindrical portion 112*a*, sized so that the slug 80 slides easily therethrough. Guide block 116 has a mating bore 116*a* formed therein, sized for free passage of line 60, and also defines an enlarged recess 116*b* sized to receive slug 80. Accordingly, when cylinder 100 is rotated to the correct position, slug 80 can pass therethrough and into recess 116*b* in guide block 116, but cannot pass therethrough. Contoured bore 112 in cylinder 100 is also formed to define a notch portion 112*b*, sized to fit snugly around the line 60, and opposed partial chamfers 112*c* and 112*d*, sized to receive the slug 80, on opposed sides of the lower and upper openings in the bore 112. The functions of these various contours of bore 112 will be made clear in the following.

More particularly, FIG. 8 shows the position of cylinder 100 as line 60 is pulled upwardly, as in preparation for flying the spinnaker or in completing a jibe, so that slug 80 has entered contoured bore 112. As illustrated, as it enters bore 112, slug 80 interacts with lower chamfer 112*c* to rotate cylinder 100 counterclockwise, against the bias of spring 106', from its rest position (as in FIG. 9). That is, the lower chamfer 112*c* is formed so that as the slug is pulled into the bore 112, the slug bears against the chamfer 112*c*, rotating cylinder 100 counterclockwise and allowing slug 80 to pass upwardly through bore 112. As the bore 112 in cylinder 100 and the recess 116*b* in guide block 116 are then aligned, slug 80 passes upwardly into recess 116*b*; when slug 80 exits bore 112, cylinder 100 is released, so that spring 106' rotates cylinder 100 clockwise, to the position shown in FIGS. 9 and 9B. The notch portion 112*b* of bore 112 then fits snugly around line 60, so that slug 80 rests on the surface of cylinder 100 around notch 112*b*, preventing slug 80 from being removed from recess 116*b*. See FIG. 9B. When this has been accomplished, car 50 is fixed with respect to line 60, since slug 80 is fixed to line 60. Accordingly, from the crewmember's point of view all that need be done in order to ready the system for flying the spinnaker is to pull the line upwardly through the car until the slug enters the recess 116*b*; at that point, the cylinder rotates clockwise to the FIG. 9 position, securing the slug 80 to the car 50. Preferably spring 106' is sufficently powerful, and the cylinder 100 rotates sufficently freely, that this occurs with an audible "snap", so that the crewmember is assured that the slug is securely retained in the recess 116*b*. Under these circumstances, as explained above, pulling on the line 60 will move the car 50 and pole tip 29 (FIG. 4) together, so that the pole moves parallel to the deck.

As noted above, when it is desired to jibe the boat, the line 60 is freed from the car. Freeing the line is conveniently accomplished in the embodiment shown by the crewmember's pulling the line 60 against the forward edge of the lower end of bore 112 in cylinder 100, that is, forward, off its normal axis, in the direction opposite lower chamfer 112*c*. See FIG. 10. As illustrated, the lower end of bore 112 is not chamfered significantly where line 60 bears on it in these circumstances, so that pulling line 60 against this forward edge rotates cylinder 100 until bore 112 is again aligned with recess 116*b*. Accordingly, a single pull on the line in the correct direction releases slug 80, allowing it to be pulled downwardly. Upper chamfer 112*d* is provided to allow slug 80 to enter bore 112 from recess 116*b* in these circumstances. The system is then operable as in FIG. 5; pulling the line down from the car simultaneously raises the car and slacks the topping lift, so that the tip of the pole drops. After the tip of the pole has been passed between the forestay and deck, the line is pulled in the opposite direction until slug 80 again enters car 50 and is retained therein, as described above in connection with FIG. 8.

As mentioned above, it is desired that the slug be released automatically from the cylinder when the car is lowered to the inactive position, freeing line 60 so that the topping lift portion 25 can be stowed out of the way, and that the car be retained in its inactive position until the slug re-enters the cylinder as the line is pulled therethrough in preparation for flying the spinnaker, at which point the car is released automatically from the inactive position. These functions are accomplished through the cooperation of a control arm 122 and a further recess 120 formed in cylinder 100. Control arm 122 is fixed with respect to track 42, near the bottom of mast 12, and recess 120 is aligned to receive control arm 122 when the car 50 is lowered to the bottom of track 42, e.g., at the conclusion of use of the spinnaker.

As shown by FIGS. 9A, 11A, and 12A (which correspond to FIGS. 9, 11 and 12, respectively), the shapes of control arm 122 and recess 120 are such that when the car is lowered and control arm 122 enters recess 120, cylinder 100 is rotated so as to release slug 80. That is, FIG. 9A shows the relation of recess 120 to control arm 122 when car 50 is spaced some distance from the base of the mast 12, i.e., when the spinnaker is being flown. Recess 120 is generally triangular, as is control arm 122. Recess 120 is formed to comprise a lip 120*a*, which bears on an inclined cam surface 122*b* of control arm 122 as car 50 is lowered, so that as the car is lowered and control arm 122 enters recess 120 (FIG. 11A), cylinder 100 is rotated counterclockwise, against the bias of spring 106', until it reaches the position shown in FIG. 11, where bore 112 and recess 116*b* are aligned, freeing slug 80, and allowing it and line 60 to be pulled downwardly. When the car 50 is then pulled downwardly further from the FIG. 11A position, to the position shown in FIG. 12A, the bias from spring 106' causes cylinder 100 to now rotate clockwise slightly, so that lip 120*a* fits under land 122*a* on 26 control arm 122, as shown in FIG. 12A. In this position control arm 122 retains car 50, and holds cylinder 100 such that bore 112 is aligned so as to readily receive slug 80.

When it is later desired to fly the spinnaker, line 60 is pulled upwardly through car 50 once again; as discussed in connection with FIG. 8, as the slug 80 enters recess 116*b* from bore 112, cylinder 100 is then rotated counterclockwise against the bias of spring 106', so that lip 120*a* is disengaged from beneath land 122*a*, releasing car 50 from control arm 122.

As illustrated in FIG. 7, cylinder 100 can be assembled of two components to enable machining of recess 120; alternatively, recess 120 might be cast into cylinder 100. Still further, the cooperation provided by control arm 122 and recess 120 might be provided by separate components cooperating when the car is lowered to its inactive position, to release the line 60 and retain the car 50 in the active position until prepared for use. Other modifications of the structure shown are within the skill of the art, and may be made in order to provide further operational possibilities, as now described.

As mentioned above, certain boats employ a "penalty pole", which is proportionally longer than the pole shown in the drawings hereof. When in the inactive position, that is, secured along the foredeck, such a penalty pole typically protrudes under a railing or "pulpit", provided at the bow for crew safety. Accordingly, the topping lift cannot be used to raise the tip of the pole directly. In such circumstances, it is necessary to raise the mast end of the pole first, pulling the outboard tip aft until it is clear of the pulpit; at that point the outboard tip is raised until the pole is parallel to the deck, and thereafter the pole is moved as described above.

In order to facilitate this in accordance with the invention, in such circumstances a somewhat modified control arm 122 is mounted to the mast at a predetermined height above the deck, such that when the mast end of the pole reaches that height, the outboard end is clear of the pulpit. The track extends lower, to a point near the deck. Thus, prior to being raised into the active position, the mast end of the pole is affixed to the car, near the bottom of the mast, and the outboard end rests on the deck. The topping lift is attached to the outboard end of the pole, and runs under the pulpit, and the slug is spaced away from the car. As the pole control line is pulled, the car is raised without lifting the outboard end of the pole, since the tackle is active only as to the car; that is, the presence of the tackle effectively reduces the weight of the car and inboard end of the pole, so the car is lifted first. When the car reaches a predetermined height, it is engaged by the modified control arm, and remains stationary. Further pulling on the line therefore lifts the outboard end of the pole. The slug is located along the line so that it reaches the car, releasing the car from the control arm, just as the pole becomes parallel to the deck. In subsequent spinnaker-flying, the system of the invention operates essentially as described above, and the inverse steps are followed when spinnaker operations are completed. Modification of the control arm and its interaction with the car to permit the car to be lowered past the arm while providing the control functions described herein is within the skill of the art.

Figure 13:
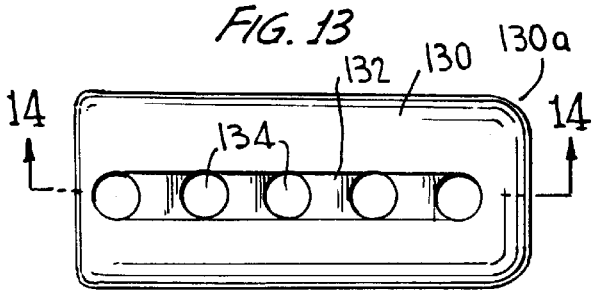
FIG. 13 is an elevational view of one implementation of the slug.
Figure 14:
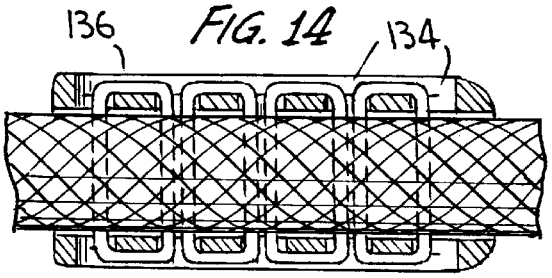
FIG. 14 is a cross-sectional view along line 14—14 of FIG. 13.

As mentioned, FIGS. 13 and 14 show one implementation of the slug 80, and FIGS. 15–18 show a second implementation of the slug and explain its assembly to a preferred type of rope to be employed as pole control line 60. In FIGS. 13 and 14, the slug comprises a tubular member 130, typically of aluminum or stainless steel, provided with two longitudinal recesses 132 on opposed portions of its outer surface. One end of the slug can be given a substantial radius, as indicated at 130*a*, to ease its entry into the bore in cylinder 100; the other end is not raduised as extensively, to ensure the slug is securely retained by the edge of the bore in the cylinder. A number of holes 134 are drilled from within the recesses 132 across the central lumen of the tubular member; stitches 136 of sailmaker's twine are then used to secure the slug to the line 60 at a desired position therealong. Recesses 132 are provided so that the twine is not proud of the surface of slug 80, avoiding abrasion and preventing the slug's becoming caught on protrusions and the like as it is moved.

As noted, the desired position at which slug 80 is secured along line 60 is determined when the improved spinnaker pole handling system of the invention is installed on a given boat. Essentially the line is rove from the tip of the spinnaker pole, over sheaves 62, 64, 74, 76, 66, and 68 (see FIG. 3) in sequence, with the car 50 on the deck, and tensioned until the topping lift portion just begins to lift the tip of the pole. The line is then slacked slightly, and the slug attached so the car and pole tip are lifted essentially simultaneously.

Figure 16:
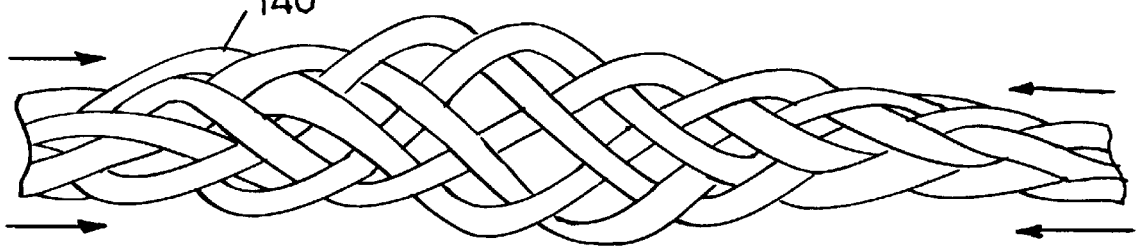
Figure 17:
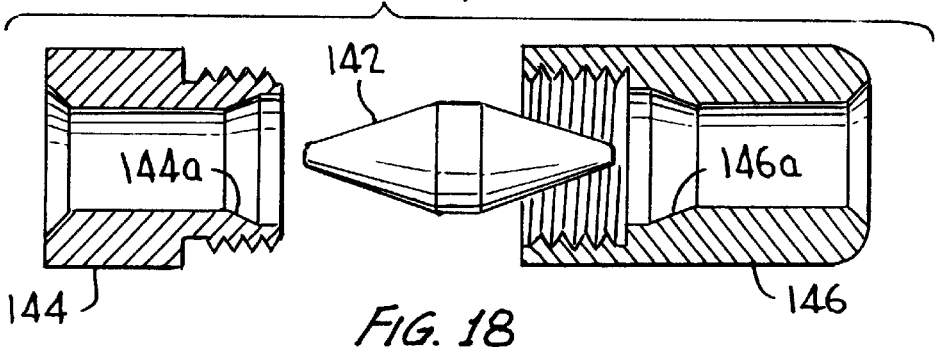
FIG. 17 is an exploded view of a second implementation of the slug, in partial cross-section.
Figure 18:
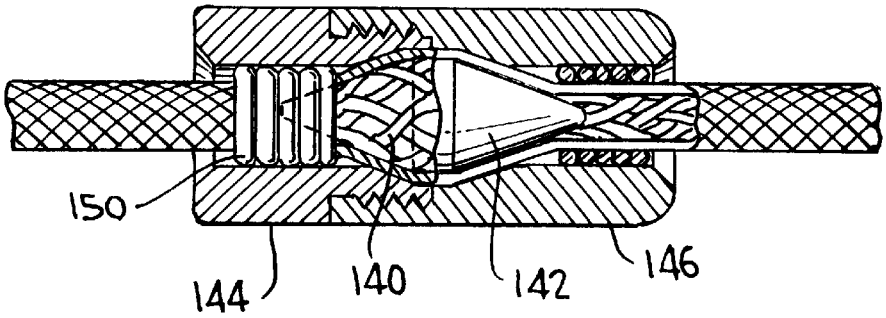
FIG. 18 is a view including a partial cutaway showing the slug in the FIG. 17 implementation after assembly on the preferred line.

As indicated, FIGS. 15–18 show another embodiment of the slug, intended for use with a preferred type of line. The preferred line is braided of a number of strands of a high tensile strength, ultraviolet-resistant material, such as that sold as "Spectra" or "Vectran". Either can be provided with a further cover, increasing its diameter and making the line easier to handle. However, the cover is typically removed except where the line will be handled in the cockpit, to save weight aloft. The braid typically comprises 8–12 strands, the latter being illustrated by FIG. 15 at 140. If any cover is removed, and the ends of a short section of the braid are urged together, the strands separate as shown in FIG. 16. According to the invention, as shown in FIGS. 17 and 18, a biconical core member 142 typically turned of stainless steel is inserted into the center of the stranded line 140, and mating male and female shell components 144 and 146 respectively are assembled thereover. As illustrated, the shell components are formed with conical inner surfaces tapered at the same angle as biconical core member 142. The biconical member 142 and shell components 144 and 146 are sized so that when the shell components are threaded together, the strands of braid 140 are compressed substantially uniformly therebetween, as shown in FIG. 18. The slug is thereby affixed very securely to the braid, without damaging the strands in any way; moreover, all tension applied to the line is transferred to the slug, and each of the strands experiences the same load. The core may be whipped with sailmakers' twine before assembly, as indicated at 150, for improved abrasion resistance, but this is not needed to prevent unraveling of the core, since the strands are not cut.

It will be appreciated that the combination of the slug and the combination of rotating cylinder and guide block disclosed above provide a mechanism for reliably but conveniently securing a line at a given point therealong, while permitting instantaneous release of the line when necessary. In particular, the line termination of FIG. 18 is extremely durable, since the load is all taken by the slug, and is transferred directly and equally to all of the strands of the core by the compression between the shell members and biconical member, and without reliance on friction between the outer surface of line and a gripping device. Such a mechanism may find use on sailboats (and elsewhere) beyond its use as part of a spinnaker pole control mechanism as described above.

For example, halyards (lines used to hoist sails) are typically secured by "rope clutches", which are devices that grip lines between toothed cams; such clutches can be very hard on lines, especially where the lines tends always to grip the line in the same place, as in the case of halyards. Although the core of a two-piece line, as described above, carries all the tension, a cover is typically provided to reduce wear on the core, and the gripping of the clutch therefore requires substantial compression of the cover between the clutch and the core. The combination of the slug and locking cylinder mechanism of the invention, or a functionally similar mechanism for receiving and securely retaining the slug, while allowing it to be readily released, is a direct replacement for rope clutches in such applications.

As will be apparent, the "line stopper" system thus provided according to the invention could be implemented in several ways, all within the scope of the invention. For example, the rotating cylinder 100, which is moved from its rest position when the slug enters its contoured bore, so that the slug can pass therethrough, and is then biased back to its rest position, preventing the slug from being withdrawn, can be replaced by a device wherein the "bore" is provided by mating grooves in opposed jaws, one formed on a base fixed to the structure with respect to which the line is to be secured (e.g., to the deck), and the other mounted on a member pivoted on the base and spring-loaded to bring the jaws together. The inlet sides of the grooves in the jaws are contoured so that the jaws are spread apart, against the spring bias, when the line and slug are pulled therethrough. After the slug passes the jaws, the spring bias brings the jaws back together, closely confining the line, and the slug bears against the rear surface. A guide member may be juxtaposed to the exit side of the jaws, having a bore for allowing the line to pass through it, and a recess for receiving the slug, so as to limit the travel of the slug.

Such a line stopper can readily replace the rope clutches now used to secure lines such as halyards that are repetitively brought to the same predetermined position; a slug according to the embodiment of FIGS. 13 and 14 or that of FIGS. 15–18 is attached to the line, and the halyard is pulled through the stopper until the slug passes the jaws. The crewmember pulling the line then knows for certain that the halyard has been brought to the desired position and secured, and can then immediately go on to other tasks with confidence. The line can be instantaneously released by lifting the pivoted member away from the base. Moreover, as noted, since the slug of the invention (especially that of the FIGS. 17 and 18 embodiment) efficiently transfers the tension load directly from the core to the outside surface of the slug, frictional gripping of the outer casing of the line or the core by a rope clutch is avoided, and line life improved. Several slugs can be provided at intervals along the line if the line is to be secured at differing predetermined positions under different circumstance.

While a preferred embodiment and several alternatives thereof have been described, the invention is not to be limited thereto, but only by the appended claims.

What is claimed is:

1. A spinnaker pole control system for a sailboat, said sailboat having a hull including a bow, a mast, a track attached to said mast for receiving a car sliding along said track, said car having a fitting for receiving an inboard end of a spinnaker pole, and a spinnaker pole, comprising:

a pole control line supporting at least an outboard end of said spinnaker pole and running from said pole to a sheave at or near the head of said mast, thence downwardly to a sheave at or near the base of said mast, thence upwardly to or through said car to a sheave at or near the upper end of said track, thence to a second sheave at or near the base of said mast, and thence to a line securing device, and means on said car for releasably securing said pole control line to said car, whereby when said line is secured to said car, motion of said line moves said car and said outboard end of said spinnaker pole in the same direction.

2. The spinnaker pole control system of claim 1, wherein a multipart tackle is interposed between said car and said sheave at or near the upper end of said track, such that when said line is secured to said car, motion of said line moves said car and said outboard end of said spinnaker pole in the same direction and at a rate determined by the mechanical advantage provided by said tackle, and when said line is released from said car motion of said line moves said car and said outboard end of said spinnaker pole in the opposite directions and at differing rates.

3. The spinnaker pole control system of claim 1, wherein said means on said car for releasably securing said pole control line to said car secures said line to said car at a predetermined point along said line.

4. The spinnaker pole control system of claim 3, wherein said predetermined point along said line is defined by a slug affixed to said line, and said car comprises a mechanism for cooperating with said slug to prevent motion of said line with respect to said car.

5. The spinnaker pole control system of claim 4, wherein said slug is a generally cylindrical member, and said mechanism comprised by said car for cooperating with said slug comprises a member defining a bore for receiving said line and said slug, said member being journaled for rotation about an axis generally perpendicular to the axis of said bore, and said member being spring biased with respect to said axis toward a rest position, whereby said member must be urged away from said rest position against said bias to allow said slug to be drawn into said bore.

6. The spinnaker pole control system of claim 5, wherein after said slug has been drawn into and through said bore in a first direction, said spring bias moves said member toward said rest position and thereby prevents said slug from being withdrawn through said bore in the opposite direction, whereby said slug is releasably secured with respect to said member after being drawn through said bore in said first direction.

7. The spinnaker pole control system of claim 5, further comprising a control guide juxtaposed to said member, said control guide comprising a bore through which said line extends, and comprising a recess for receiving said slug after being drawn through said bore in said member in said first direction.

8. The spinnaker pole control system of claim 7, wherein the spring bias provided to said member is arranged such that an edge of said bore in said member bears against an end of said slug when said slug is received in said bore in said control guide, preventing said slug from being withdrawn from said recess absent movement of said member against said bias.

9. The spinnaker pole control system of claim 8, wherein said slug is a generally tubular member such that said line fits through a lumen in said slug, and wherein a notch is formed in the edge of said bore in said member juxtaposed to the bore in said control guide, said notch fitting around said line where said line exits the lumen in said slug.

10. The spinnaker pole control system of claim 7, wherein said member may be rotated against said spring bias, allowing said slug to be withdrawn from said recess, by pulling the line against an edge of said bore in said member opposite the end of said bore in said member juxtaposed to the bore in said control guide.

11. The spinnaker pole control system of claim 5, wherein said member defining a bore for receiving said line and said slug is a generally cylindrical member journaled with respect to said car for rotation about an axis perpendicular to said mast.

12. The spinnaker pole control system of claim 4, further comprising a control arm fixed to said mast, said control arm being adapted to cooperate with said mechanism such that when said car is moved along said track to a predetermined position, said control arm causes said slug to be released by said mechanism.

13. The spinnaker pole control system of claim 12, wherein said control arm cooperates with said mechanism such that after said car has been moved in a first direction along said track to said predetermined position, releasing said slug from said mechanism, said control arm retains said car at said predetermined position along said track.

14. The spinnaker pole control system of claim 13, wherein when said slug is drawn into said bore, said car is released from said control arm.

15. The spinnaker pole control system of claim 4, wherein said pole control line is stranded and said slug comprises a biconical core member and male and female threaded members, said male and female threaded members having lumens therethrough and mating cavities therein for together receiving said biconical core member, such that said slug is affixed to said line by threading said line through the lumens of said male and female members, disposing said biconical core member between the strands of said line, and threadedly securing said male and female members to one another, thereby confining said biconical member in the mating cavities of said male and female members and gripping the strands of said line therebetween.

16. The spinnaker pole control system of claim 4, wherein said slug is a generally tubular cylindrical member having a lumen through which said line passes, said generally tubular cylindrical member defining elongated recesses on opposed sides of its outer surface, and pairs of holes drilled in said recesses for receiving twine extending across the lumen of said slug, securing said slug to said line.

17. A line stopper system for allowing a line to be drawn in a first direction to a predetermined position with respect to a related structure and be secured in said predetermined position against tension applied in the opposite direction, and to be instantly released therefrom, comprising:

a slug adapted to be fixed to said line at a point determined with respect to said predetermined position; and a member pivotally mounted with respect to said structure so as to resist tension applied by said line in said opposite direction, while being permitted to pivot with respect to said structure, said member being spring biased to a rest position, said member being adapted to receive said slug and line and move against said spring bias when said line is drawn past said member in said first direction, and to return to said rest position when said slug has passed a retention surface on said member, so that said slug bears against said retention surface, preventing said line and said slug from being withdrawn in said opposite direction from said member.

18. The line stopper system of claim 17, further comprising a guide structure for receiving said line and said slug after having passed said member, to ensure that said line and slug remain in a predetermined position with respect to said member.

19. The line stopper system of claim 18, wherein said guide structure comprises a bore through which said line passes, and a recess for receiving said slug, such that said guide structure prevents said line from being drawn past said predetermined position.

20. The line stopper system of claim 17, wherein said member has a contoured bore formed therethrough through which said line and slug pass, said contoured bore being shaped to define a chamfer against which said slug bears when first drawn in said first direction, causing said member to be moved against said spring bias and allowing said slug to pass thereby.

21. The line stopper system of claim 20, wherein said contoured bore comprises a notch, disposed at the opposite end of said bore from said chamfer, and sized to fit around said line when said member is in its rest position, the end of said slug bearing against a surface of said member surrounding said bore.

22. The line stopper system of claim 17, wherein said slug comprises a biconical core member and male and female threaded casing members having lumens therethrough and mating cavities therein for receiving said biconical core member, such that said slug is affixed to said line by threading said line through the lumens of said male and female members, disposing said biconical core member between the strands of said line, and threadedly securing said male and female members to one another, thereby confining said biconical member in the mating cavities of said male and female members and gripping the strands of said line between said biconical member and said male and female members.

23. The line stopper system of claim 17, wherein said slug is a generally tubular cylindrical member having a lumen through which said line passes, said tubular cylindrical member defining recesses on opposed sides of its outer surface, and pairs of holes drilled in said recess for receiving twine extending across the lumen of said slug, securing said slug to said line.

24. A method of controlling the position of a spinnaker pole with respect to a sailboat, said sailboat comprising a hull, a mast fixed to said hull, a track fixed to said mast, a car adapted to slide along said track, a fitting for receiving one end of said spinnaker pole affixed to said car, and a pole control line supporting at least an outboard end of said spinnaker pole and running from said pole to a sheave at or near the head of said mast, thence downwardly to a first sheave at or near the base of said mast, thence upwardly to or through said car to a sheave at or near the upper end of said track, thence to a second sheave at or near the base of said mast, and thence to a line securing device, and means on said car for releasably securing said pole control line to said car, said method comprising the step of:

securing said line to said car when it is desired to move said car and said outboard end of said spinnaker pole in the same direction by motion of said line.

25. The method of claim 24, comprising the further step of securing said line to said car by drawing said line through said car until a slug fixed to said line at a predetermined position therealong is engaged by a mechanism on said car.

26. The method of claim 25, comprising the further step of releasing said slug from said mechanism by pulling said line off-axis with respect to its normal direction of elongation.

27. The method of claim 24, wherein said sailboat further comprises a foreguy extending from the bow of said boat to said spinnaker pole, and said method comprises the further step of lowering said pole by slacking said pole control line and simultaneously tensioning said foreguy.

28. The method of claim 24, wherein a first further sheave is affixed to said mast at or near the upper end of said track and a second further sheave is affixed to said car, said pole control line being rove over said first and second further sheaves to form a multipart tackle effecting a mechanical advantage effective in moving said car and the outboard end of said pole in the same direction when said line is secured to said car, and said method comprising the further steps of releasing said line from said car and pulling a single run of said line in order to move said car and the outboard end of said pole in oppposite directions and at differing rates.

29. The method of claim 24, wherein a first further sheave is affixed to said mast at or near the upper end of said track and a second further sheave is affixed to said car, said pole control line being rove over said first and second further sheaves to form a multipart tackle effecting a mechanical advantage effective in moving said car and the outboard end of said pole in the same direction when said line is secured to said car, and said method comprising the further steps of releasing said line from said car and pulling simultaneously on the runs of said pole control line between said sheave at or near the upper end of said track and said second sheave at or near the base of said mast, and between said first further sheave at or near the upper end of said track and said first sheave at or near the base of said mast, in order to move the car and the outboard end of said spinnaker pole in opposite directions and at substantially similar rates.

* * * * *